United States Patent [19]

Geringer et al.

[11] Patent Number: 4,826,223

[45] Date of Patent: May 2, 1989

[54] ELECTROMAGNETIC DOOR LOCK DEVICE

[76] Inventors: Arthur V. Geringer, 4611 Deseret, Woodland Hills, Calif. 91364; Richard G. Geringer, 28834 Barragan St.; David A. Geringer, 5382 Cheseboro Rd., both of Agoura, Calif. 90301

[21] Appl. No.: 118,972

[22] Filed: Nov. 10, 1987

Related U.S. Application Data

[63] Continuation of Ser. No. 702,808, Feb. 19, 1985, abandoned.

[51] Int. Cl.[4] ..... E05C 17/56

[52] U.S. Cl. ..... 292/251.5; 292/144

[58] Field of Search ..... 292/251.5, 144, DIG. 15, 292/302, 74

[56] References Cited

U.S. PATENT DOCUMENTS

| | | | |
|---|---|---|---|
| 3,350,127 | 10/1967 | Hekelaar | 292/251.5 |
| 3,794,366 | 2/1974 | Graham | 292/144 |
| 4,257,631 | 3/1981 | Logan, Jr. | 292/251.5 |
| 4,401,346 | 8/1983 | Jones et al. | 292/251.5 |
| 4,439,808 | 3/1984 | Gillham | 292/144 X |
| 4,487,439 | 12/1984 | McFadden | 292/74 X |
| 4,652,028 | 3/1987 | Logan et al. | 292/251.5 |

*Primary Examiner*—Richard E. Moore

*Attorney, Agent, or Firm*—John J. Posta, Jr.

[57] ABSTRACT

The device includes an electromagnet, a bracket for holding the electromagnet in a door frame to force the opening therein, an electrical conduit for connecting the electromagnet to a power source, an armature magnetically attracted to the electromagnet when the latter is energized, a connector for holding the armature on a door edge in the frame for adjustable movement towards the electromagnet and a lock component for the device. The lock component comprises one or more ledges at the periphery of the electromagnet and/or armature pair projecting towards and engageable with the other(s) of the pair when the armature is magnetically attracted to the energized electromagnet. This occurs when the armature and electromagnetic are in line with each other, the armature being free to move toward the electromagnet. Unlocking is effected by deenergizing the electromagnet and allowing the armature to retract by gravity or spring action, so that the lock component also moves out of the described engagement. The device is simple, durable and effective.

12 Claims, 3 Drawing Sheets

ELECTROMAGNETIC DOOR LOCK DEVICE

This is a continuation of application Ser. No. 702,808, filed Feb. 19, 1985, now abandoned.

BACKGROUND OF THE INVENTION

1. Field of the Invention

The present invention generally relates to locking mechanisms and, more particularly, to an improved electromagnetic door lock device.

2. Prior Art

There are a large number of different types of electromagnetic door locks, most of which are complicated and expensive to manufacture, install and service and many of which do not perform efficiently. One particular lock as for example is shown in U.S. Pat. No. 4,487,439 which issued on Dec. 11, 1984, to William C. McFadden and entitled Magnetic Shear Locking Methods and Apparatus utilizes a locking mechanism which operates under shear. However, this device utilizes a specially configured electromagnet housing. When an armature is attracted thereto during locking, a small central tab on the housing extends into a central armature dimple to prevent the armature and the door to which it is attached from moving. Such an electromagnet housing configuration is expensive to make. Moreover, great care must be made to align the armature and housing, specifically, the central dimple and tab, otherwise the lock will malfunction. Of more importance, considerable shear stress can occur to the housing with resultant cracking and disruption of the electromagnet, particularly if an attempt is made to force the door open while it is in the locked position. Finally, the device is not adapted to a wide variety of applications.

Accordingly, there is a need for an improved, less expensive, more durable and efficient electromagnetic door locking device. Such device should be simple to make, install, inspect, repair and replace. It should also be designed to protect the electromagnet against damage if the lock if forced. In addition, the device should be capable of being utilized for one-way and two-way swinging doors, sliding doors and windows and in applications where the lock is to be connected to the door frame at either the side or top.

SUMMARY OF THE INVENTION

The improved electromagnetic door locking device of the present invention satisfies all the foregoing needs. The device is substantially as set forth in the Abstract above. Thus, the device employs an electromagnet, including a housing secureable by a bracket in a fixed position on the top or side of a door frame. The housing generally has a relatively flat side adapted to face the opening defined by the door frame.

The device also includes an armature in the form of a plate or the like which is attracted to the electromagnet when the latter is energized. The armature can be mounted on the edge of a door in the frame so that it is aligned with and faces the electromagnet when the door is closed. The connector which mounts the armature on the door is adjustable so that when the armature is magnetically attracted to the electromagnet it freely moves toward it, engaging a lock component carried by the outer periphery of the armature and/or electromagnet housing with the other of the armature-electromagnet pair. The lock component automatically disengages when the electromagnet is deenergized, because the armature then automatically retracts by gravity or spring action from proximity to the electromagnet.

In one embodiment, the lock comprises a pair of plates bearing tabs connected to and depending from opposite sides of the housing of a top mounted electromagnet. When the armature is mounted on a hinged door and swung into alignment with the electromagnet, and then attracted to it by energizing the electromagnet, it is trapped by the tabs until the electromagnet is deenergized. The armature-electromagnet aligning occurs when the door is closed.

In another embodiment, a pair of spaced side plates depend from the electromagnet housing which is adapted to be mounted on the top of a door frame. The side plates trap an armature mounted on the top of a sliding door, in the general manner previously described for the swinging door arrangement. Thus, when the door is closed, the armature is aligned with the electromagnet. When the latter is energized, locking occurs.

In another embodiment, the lock component comprises a box containing the electromagnet in a recessed position accessible through an open box side adapted to face the opening defined by a door frame. When the armature is aligned with the electromagnet and attracted to it, it partially enters the box and is locked thereto. In a similar embodiment, the lock component includes raised peripheral ledges connected to the armature, which ledges can extend into the box.

Further features of the invention are set forth in the following detailed description and accompanying drawings.

DRAWINGS

DETAILED DESCRIPTION

FIGS. 1-3

Figure 1:
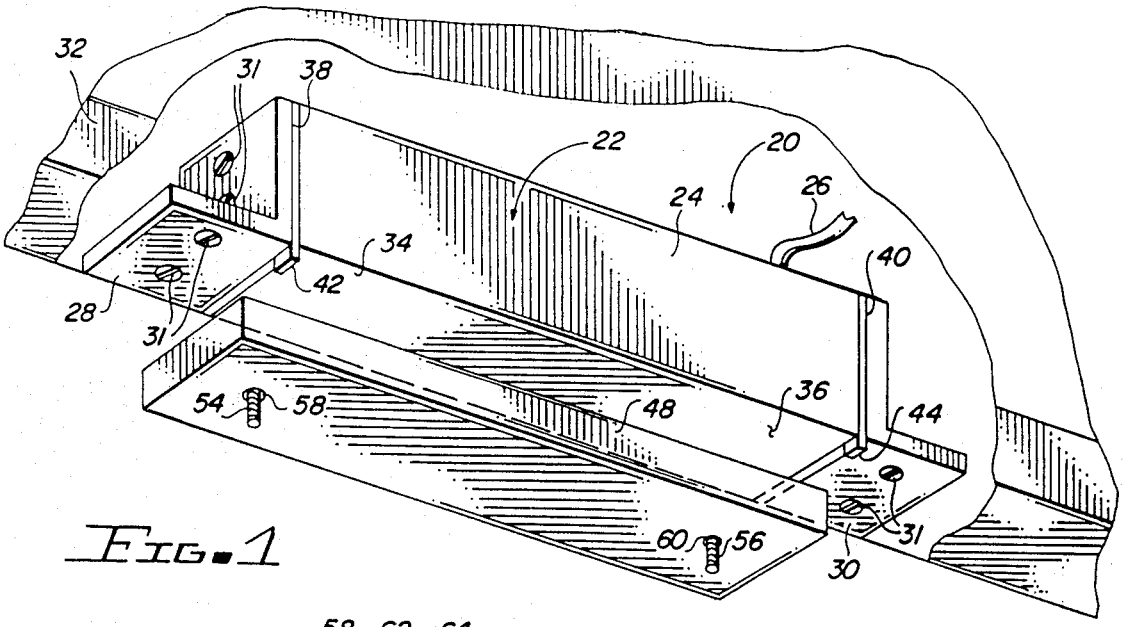
FIG. 1 is a schematic perspective view of a first preferred embodiment of the improved locking device of the present invention, showing the electromagnet thereof mounted in the top of a door frame.
Figure 2:
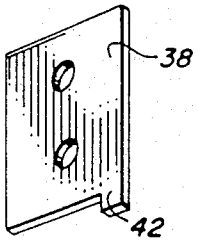
FIG. 2 is a schematic perspective view of one of the locking plates of FIG. 1.
Figure 3:
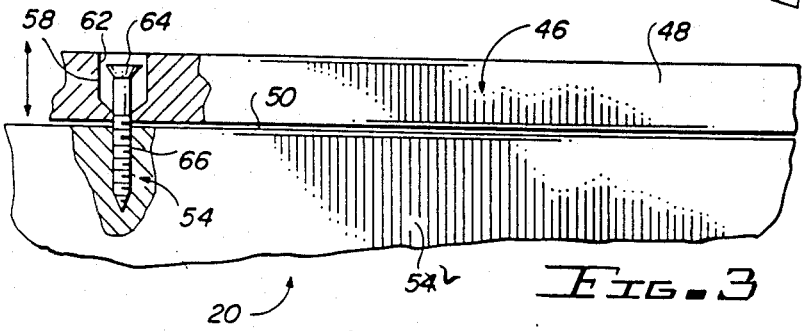
FIG. 3 is an enlarged schematic side elevation, partly broken away, of the armature of FIG. 1 adjustably connected to the top of a door.

A first preferred embodiment of the improved locking device of the invention is shown in FIGS. 1-3. Thus, device 20 is depicted, which comprises an electromagnet 22 disposed in a rectangular housing 24 and connected via an electrical conduit 26 with a remote power source (not shown). Electromagnet 22 can be of any conventional construction and is shown mounted to a pair of L-shaped brackets 28 and 30 by screws generally designated 31, and by screws 31 and brackets 28 and 30 to the underside of a door frame 32 so that one flat side 34 of housing 24 faces the opening 36 defined by frame 32.

Device 20 also includes a pair of flat locking plates 38 and 40 mounted between brackets 28 and 30 respectively, and bearing tabs 42 and 44 depending from the front edges thereof.

Device 20 also includes an armature 46 in the form of an elongated rectangular plate 48 which is magnetically attracted to electromagnet 22 when the latter is energized. Plate 48 is shown in FIG. 3 mounted on the top edge 50 of a door 52 disposed in opening 36 of frame 32 (see FIG. 3) and hinged to swing on one side of frame 32.

A spaced pair of screws 54 and 56 are disposed in unthreaded openings 58 and 60, respectively, in plate 48. Openings 58 and 60 have expanded upper portions 62 to freely accommodate the expanded heads 64 of screws 54 and 56. Threaded openings 66 in door 52 adjustably receive the shanks 68 of screws 54 and 56, so that the spacing and free play between plate 48 and edge 50 can be adjusted by adjusting the height of screws 54 and 56 in door 52. Thus, the extent that plate 48 can move toward side 34 of electromagnet 22 when magnetically attracted thereto can be very readily adjusted by screws 54 and 56.

It will be noted that when electromagnet 22 is energized and plate 48 is aligned directly therebelow, that is, when door 52 is closed in frame 32, plate 48 moves up towards side 34 sufficiently far to lie forward of and abutting tabs 42 and 44. Thus, door 52 is prevented from opening, tabs 42 and 44 acting as locking components. So long as electromagnet 22 remains energized, plate 48 remains trapped by tabs 42 and 44 and door 52 remains locked.

When electromagnet 22 is deenergized, plate 48 automatically falls by gravity to the position shown in FIG. 3 on top of door edge 50, thus clearing the bottom of tabs 42 and 44 and allowing door 52 to open. With this locking arrangement, no damage is done to relatively costly electromagnet 22 or housing 24 if door 52 is forced open while locked. The forcing stress all occurs in locking plates 38 and 40, which are inexpensive and are easily and quickly replaced. They are also easily reversed, so as to work effectively with a door hinged to open from the opposite direction. Moreover, tabs 42 and 44 are well spaced apart and have much greater holding power than a single central tab in certain prior art devices.

Accordingly, device 20 has improved utility and simplicity. Its components can be fabricated of suitable, durable, inexpensive metal, such as steel or the like, and other materials. If desired, plates 38 and 40 can be of non-magnetic metals or the like to facilitate smooth operation of device 20.

FIG. 4

Figure 4:
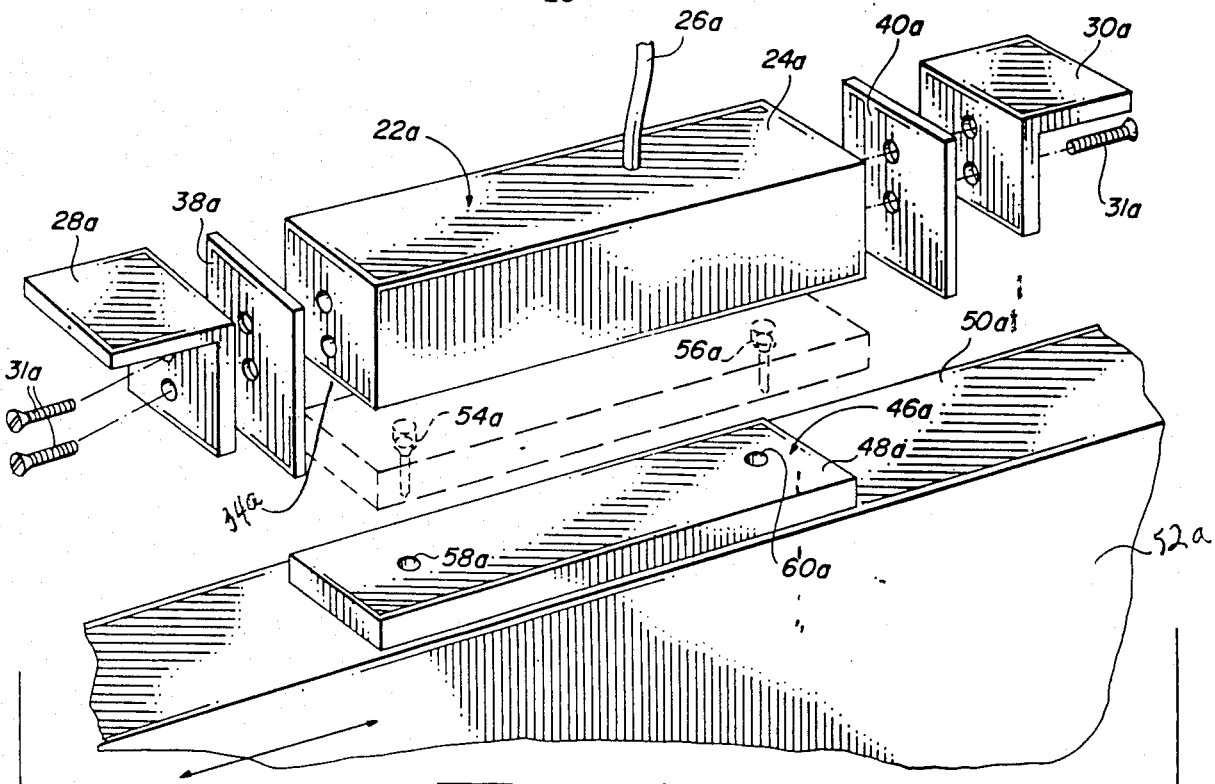
FIG. 4 is a schematic, partially exploded perspective view of a second preferred embodiment of the improved locking device of the present invention.

A second preferred embodiment of the improved locking device of the invention is schematically depicted in FIG. 4. Thus, device **20*a* is shown. Components thereof similar to those of device 20 bear the same numerals, but are succeeded by the letter "a". Device 20*a* is identical to device 20, except that brackets 28*a* and 30*a* are inverted and plates 38*a* and 40*a* do not have tabs as such. However, the lower edges thereof depend below side 34*a*. Electromagnet 22*a* is adapted to be mounted at the top of a frame above a track in a sliding door assembly, and plate 48*a* is adapted to be mounted on the top edge 50*a* of sliding door 52*a* disposed in such tracks (not shown). When plate 48*a* is aligned directly below side 34*a* and electromagnet 22*a* is energized, plate 48*a* moves up and is trapped between the depending edges of plates 38*a* and 40*a*, thus locking door 52*a* in place. Deenergizing electromagnet 22*a* unlocks door 52*a*. Thus, device 20*a*** is simple and effective.

FIG. 5

Figure 5:
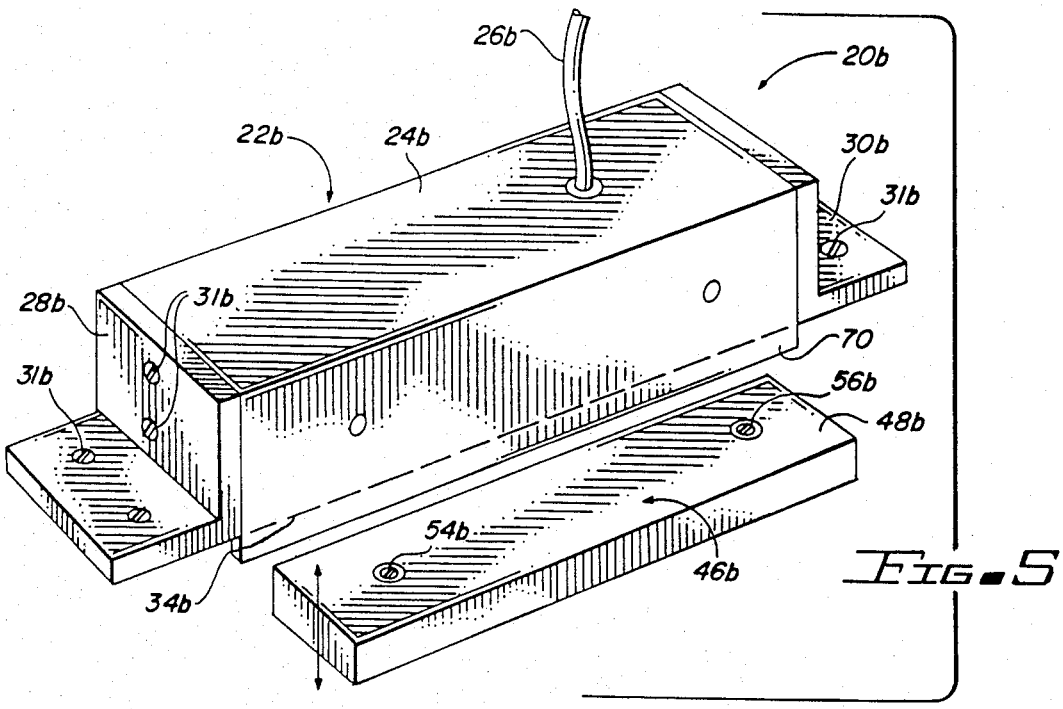
FIG. 5 is a schematic perspective view of a third preferred embodiment of the improved locking device of the present invention.

The third preferred embodiment of the lock device is shown in FIG. 5. Thus, device **20*a* is shown. Components thereof similar to those of device 20 or 20*a* bear the same numerals, but are succeeded by the letter "b". Device 20*b* differs from that of FIGS. 1-3, in that housing 24*b* has a depending front edge 70 secured thereto and extending below bottom 34*b*, and acting as the locking means for device 20*b*, instead of side locking plates. The manner of operation of device 20*b* is the same as device 20 and device 20*b*** is utilizable with a one-side swinging door arrangement.

FIG. 6

Figure 6:
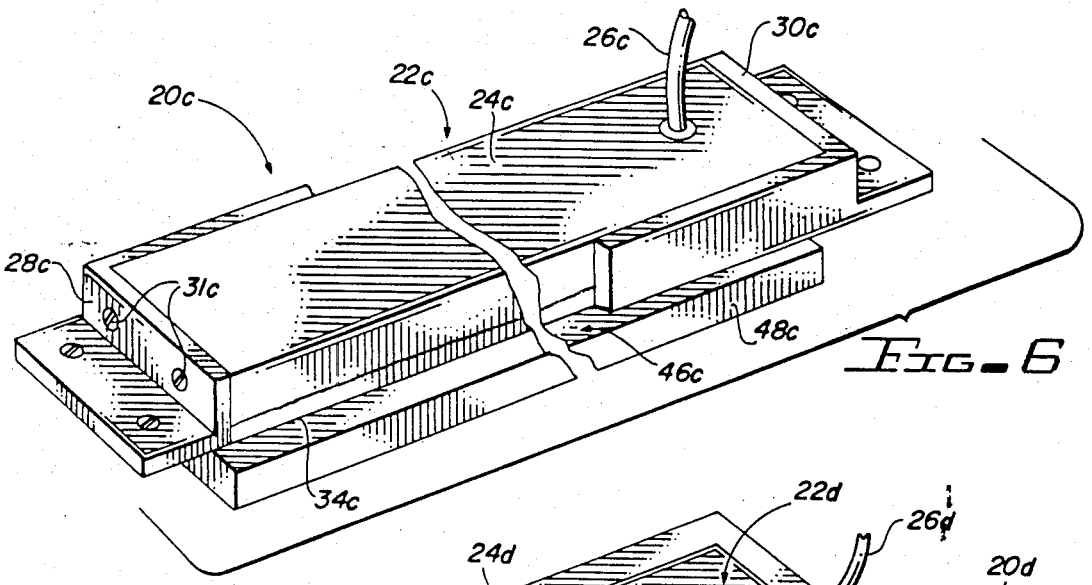
FIG. 6 is a schematic perspective view of a fourth preferred embodiment of the improved locking device of the present invention.

A fourth preferred embodiment of the improved locking device of the present invention is schematically depicted in FIG. 6. Thus, device **20*c* is shown. Components thereof similar to those of device 20, 20*a* or 20*b* bear the same numerals, but are succeeded by the letter "c". Device 20*c* is similar to device 20 except that the side brackets 28*c* and 30*c* thereof are extended to wrap around, in the case of brackets 28*c*, a portion of the rear of electromagnet 22*c*, and around a portion of the front of electromagnet 22*c* in the case of bracket 30*c*. Moreover, brackets 28*c* and 30*c* extend below bottom side 34*c* and thus act as the locking means for the device, trapping plate 48*c* of armature 46*c* therebetween. Device 20*c* is useful in applications where electromagnet 22*c* is connected to the top of a door frame (not shown), with plate 46*c*** disposed on the top of a sliding, single-opening or double-opening door (not shown).

FIGS. 7-8

Figure 7:
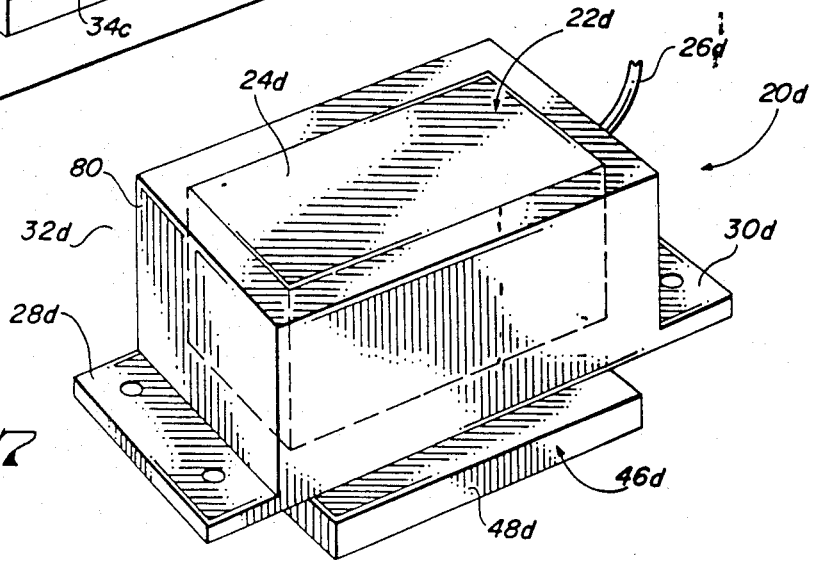
FIG. 7 is a schematic perspective view of a fifth preferred embodiment of the improved locking device of the present invention.
Figure 8:
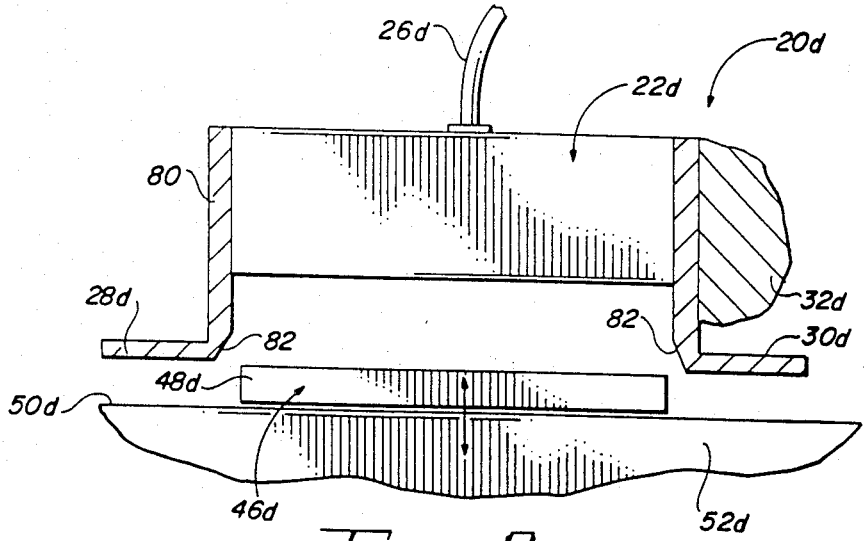
FIG. 8 is a schematic side elevation, partly in section, of the device of FIG. 7.

A fifth preferred embodiment of the invention is schematically depicted in FIGS. 7 and 8. Thus, device **20*d* is shown. Components thereof similar to those of device 20, 20*a*, 20*b* or 20*c* bear the same numerals, but are succeeded by the letter "d". Device 20*d* is similar to device 20 except for the absence of locking plates and except that brackets 28*d* and 30*d* extend to form a four sided box 80 with open top and bottom within which electromagnet 22*c* is secured in a position recessed upwardly from the bottom of box 80 (see FIG. 8). Plate 48*d* of armature 46*d* is positionable below box 80 and moveable upwardly thereinto (FIG. 3), when electromagnet 22*d* is activated so as to be held in box 80 in order to lock door 52*d*** in the closed position in frame 32*d*. Deenergizing electromagnet **22*d* causes plate 48*d* to drop down out of box 80, unlocking door 52. The lower inner edges 82 of box 80 may be beveled or cammed to facilitate guiding and centering of plate 48*d* in box 80**.

FIG. 9

Figure 9:
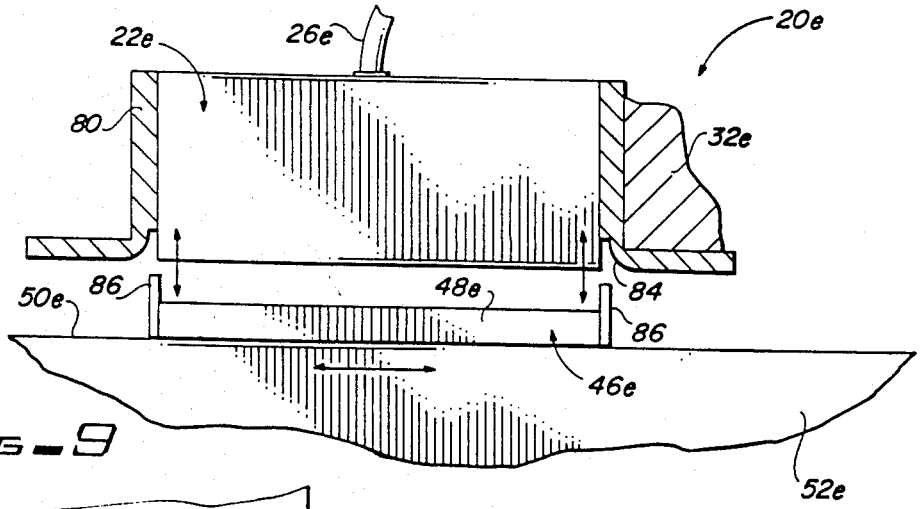
FIG. 9 is a schematic side elevation, partly in section, of a sixth preferred embodiment of the improved locking device of the present invention.

A modification of the embodiment of FIGS. 7 and 8 is shown in FIG. 9. Thus, device **20*e* is shown. Components thereof similar to device 20*d* bear the same numerals, but are succeeded by the letter "e". Device 20*e* is similar to device 20*d* except that box 80*e* has an inner pocket 84 on each of two sides near the lower end thereof, which pockets 84 receive upstanding walls 86 secured to opposite sides of plate 48*e*, when plate 48 moves up from door 52*e* toward electromagnet 22*e*. Electromagnet 22*e* is secured in the top of frame 32*e*. Thus, pockets 84 and walls 86 comprise the locking means of device 20*e* which otherwise operates identically to device 20**.

FIG. 10

Figure 10:
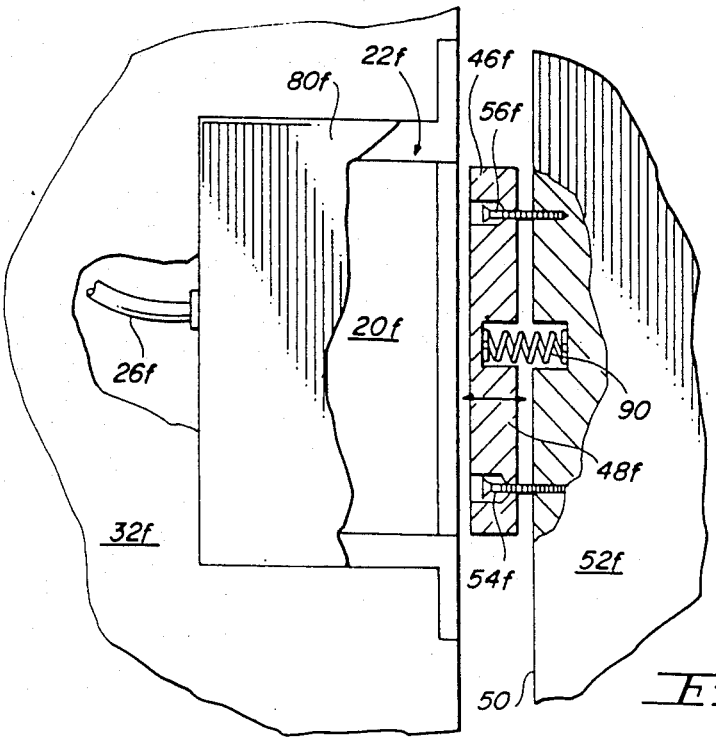
FIG. 10 is a fragmentary, schematic side elevation, partly broken away, of a seventh preferred embodiment of the improved locking device of the present invention.

A further modification form of the device of FIGS. 7 and 8 is shown in FIG. 10. Thus, device **20*f* is depicted. Components thereof similar to those of device 20*d* bear the same numerals, but are succeeded by the letter "f". Device 20*f* is similar to device 20*d* except that box 80*f* has no beveled edges and is disposed in the sidewall of frame 32*f* while plate 48*f* of armature 46*f* is connected by screws 54*f* and 56*f* to the leading side edge of door 52*f*. Plate 48*f* has a return spring 90 attached to the rear surface thereof, which spring 90 is also connected to the adjacent surface of door 54*f*. When electromagnet 22*f* is energized and plate 48*f* is aligned therewith, plate 48*f* enters and is trapped in box 80*f* to lock door 52*f* in place in frame 32*f*. When electromagnet 22*f* is then deenergized, plate 48*f* automatically retracts (by spring 90) out of box 80*f* and door 52*f*** is automatically unlocked.

Various other modifications, changes, alterations and additions can be made in the improved lock device of the present invention, its components and their parameters. All such modifications, changes, alterations and additions as are within the scope of the appended claims form part of the present invention.

What is claimed is:

1. An improved electromagnetic door lock device, said device comprising, in combination:

(a) a door frame, (b) an electromagnet housing secured to said door frame, (c) an electromagnet disposed in said housing, (d) electromagnet energization means including a power source and electrical conduit means connecting said power source to said electromagnet, (e) a door movably secured to said door frame and movable relative thereto to open and close said door, (f) an armature secured to said door at a position substantially opposite said electromagnet when said door is in a closed position, (g) said armature being magnetically attracted to said electromagnet only when said electromagnet is energized by said energization means, (h) said armature being secured to said door by adjustable connector means which permit movement of said armature between (i) an extended position towards and in substantially intimate contact with said electromagnet when attracted thereto; and (ii) a retracted position away from said electromagnet when not attracted thereto, and (i) separate door locking means secured to said door frame and disposed adjacent to said housing which is operatively associated with but separate from said housing which co-acts with said housing to prevent relative movement of said door and frame if the attractive force of the armature and the electromagnet are overcome while the electromagnet is energized, (j) a portion of said locking means being so designed and positioned as (1) to allow movement of said armature out of alignment with said electromagnet and opening of the door when said armature is in a retracted position, and (2) to prevent movement of said armature out of alignment with said electromagnet and opening of the door when said armature is in an extended position, due to the presence of said portion of the locking means in the path of travel of the armature when in such extended position.

2. The improved device of claim 1 wherein said electromagnet is suspended from the header of said door frame, wherein said electromagnet includes a housing have a smooth side facing an opening defined by said door frame, wherein said connector means connects said armature to the top edge of said door, and wherein said armature returns to the retracted position by gravity when not attracted to said electromagnet.

3. The improved device of claim 1 wherein said electromagnet is suspended from the side of said door frame adjacent the leading edge of said door, wherein said electromagnet has a housing with a smooth side facing an opening defined by said door frame, and wherein said connector means includes spring return means secured to said armature and said door for automatically retracting said armature when said electromagnet is deenergized.

4. The improved device of claim 1 wherein said locking means is releasably connected to said housing.

5. The improved device of claim 4 wherein said locking means comprises at least one plate connected to the side of said housing, said plate including a projecting tab at one end thereof adapted to trap said armature and lock said door.

6. The improved device of claim 4 wherein said locking means comprises a pair of plates disposed against opposite sides of said housing and depending therefrom.

7. The improved device of claim 4 wherein said locking means comprises a pair of spaced L-shaped brackets depending from and disposed on opposite sides of said housing and at the front and rear thereof.

8. The improved device of claim 4 wherein said locking means comprises a box having an open end, said box enclosing said housing thereof and retaining said housing in a recessed position therein.

9. The improved device of claim 8 wherein said box has beveled front edges to facilitate centering of said armature in said box adjacent said housing when magnetically attracted thereto.

10. An electromagnetic door lock assembly comprising:

(a) a door frame, (b) an electromagnet housing secured to said door frame, and having an electromagnet disposed therein, (c) electromagnet energization means for energizing said electromagnet, (d) a door movable relative to said door frame to open and close said door, (e) an armature movably secured to said door, (f) said armature being positioned so as to lie opposite said electromagnet when said door is closed, and (g) said armature being movable into engagement with said electromagnet upon energization of said electromagnet while remaining secured to said door to thereby prevent movement of said door from a closed to an open position, (h) separate door locking means secured to said door frame and disposed adjacent to said housing which is operatively associated with but separate from said housing, which co-acts with said housing to prevent relative movement of said door and frame if the attractive force of the armature and electromagnet are overcome while the electromagnet is energized, (i) a portion of said locking means extending further away from said door frame than said electromagnet and being so designed and positioned as (1) to allow movement of said armature out of alignment with said electromagnet and opening of the door when said armature is in a retracted position, and (2) to prevent movement of said armature out of alignment with said electromagnet and opening of the door when said armature is in an extended position, due to the presence of said portion of the locking means in the path of travel of the armature when in such extended position.

11. The assembly of claim 10 wherein said door is a sliding door.

12. The assembly of claim 10 wherein said door is hinged and swings open in reversed directions.

* * * * *